United States Patent [19]

Scribner

[11] 4,140,261

[45] Feb. 20, 1979

[54] SEMI-AUTOMATIC STOCK FEEDER

[76] Inventor: Albert W. Scribner, 6 Country Club Rd., Darien, Conn. 06820

[21] Appl. No.: 792,720

[22] Filed: May 2, 1977

[51] Int. Cl.[2] ..... B65H 17/36

[52] U.S. Cl. ..... 226/162; 226/134; 226/151; 72/421

[58] Field of Search ..... 226/144, 146, 147, 151, 226/158, 159, 160, 161, 162, 163, 164, 165, 166, 167, 195, 134

[56] References Cited

U.S. PATENT DOCUMENTS

| | | | |
|---|---|---|---|
| 2,406,508 | 8/1946 | Papsdorf | 226/162 X |
| 2,803,335 | 8/1957 | Powers | 226/166 |
| 3,038,645 | 6/1962 | Nordlof | 226/162 X |
| 3,846,997 | 11/1974 | Leis | 226/162 X |
| 4,000,891 | 1/1977 | Klafka | 226/151 X |

FOREIGN PATENT DOCUMENTS

| | | | |
|---|---|---|---|
| 2313100 | 9/1974 | Fed. Rep. of Germany | 226/195 |

*Primary Examiner*—Bruce H. Stoner, Jr.

[57] ABSTRACT

An improved pneumatic feeder for a punch press or the like wherein the operation of the feeder is adapted to be slaved in a semi-automatic manner to the operation of the punch press. The feeder is provided with a stock advancing feed slide and a control valve therefor whereby the stock advancing slide is normally positioned in a rearward or indexed position, and is adapted, when the feeder is triggered in response to the operation of the press, to execute a feed stroke and immediately thereafter automatically execute a non-feed stroke so as to return to said normal indexed position where it will remain until said feeder is again triggered in response to the next operation of said press. This semi-automatic action is obtained by the provision of an improved simple, relatively inexpensive and fast acting mechanical linkage for controlling the shifting action of the said feeder control valve; which linkage not only affords a much simpler mode of interfacing the feeder with the press, but requires no significant modification of the press.

18 Claims, 15 Drawing Figures

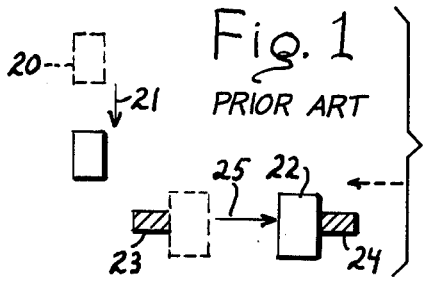
Fig. 1
PRIOR ART
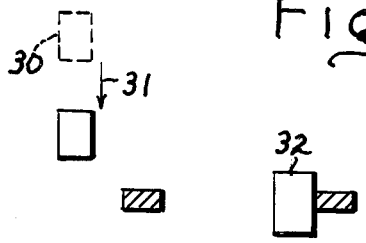
Fig. 3
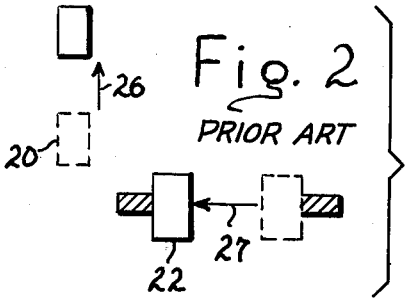
Fig. 2
PRIOR ART
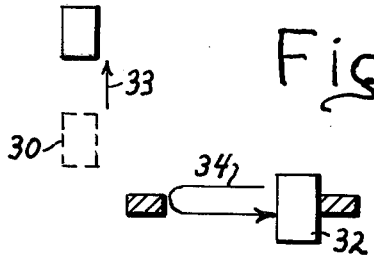
Fig. 4
Fig. 5
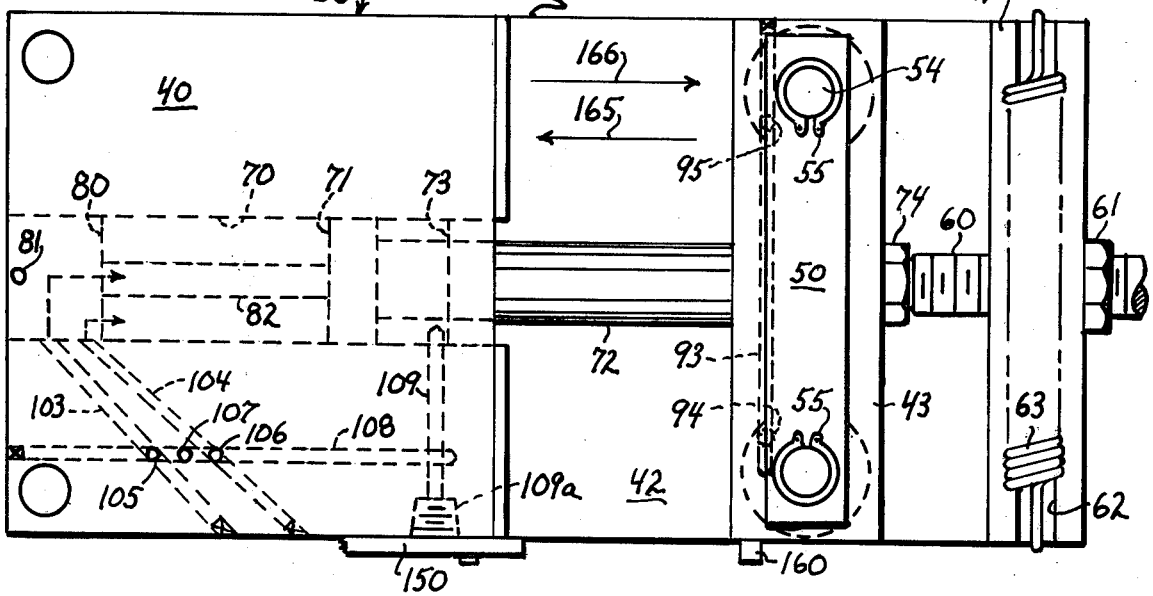
Fig. 6
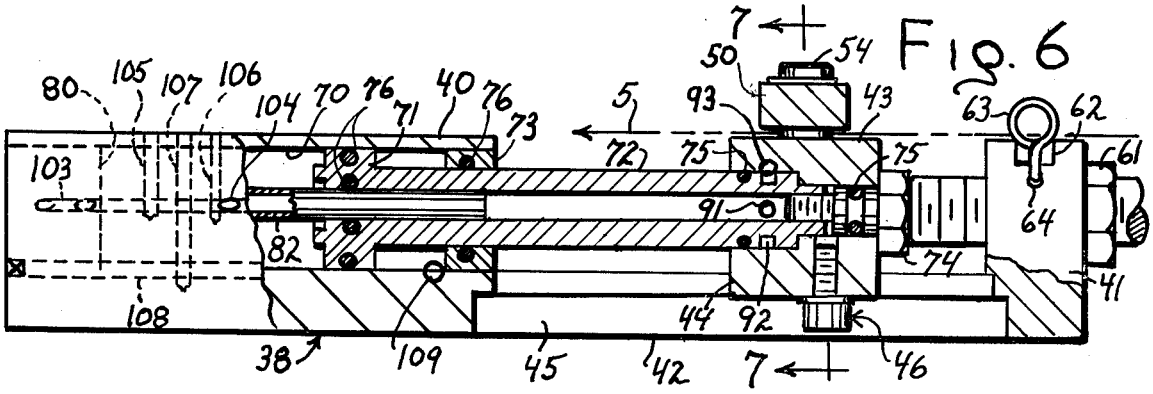

SEMI-AUTOMATIC STOCK FEEDER

BACKGROUND OF THE INVENTION

Prior semi-automatic pneumatic feeders for advancing strip stock into the work station of a punch press have been relatively expensive and have required relatively complex apparatus and procedures for interfacing the feeder with the press. For example, the press itself has in some instances been modified by the installation of a rotary feeder control cam that is adapted to be rotatably driven by the main crankshaft of the press so that the feeder valves and associated control circuits may be synchronized with the operation of the press. This type of interfacing is expensive and is relatively cumbersome in terms of set-up time and timing adjustment. Furthermore, these known types of semi-automatic pneumatic feeders may each utilize several control valves that are serially operated during each feeder cycle, and this serial action tends to cause the feeder to be slower in effective speed.

SUMMARY OF THE INVENTION

The present feeder is provided with a control valve that is adapted to be shifted between two predetermined operative positions by means of a relatively simple mechanical triggering and reversing linkage that acts directly on the valve in response to two feeder input motions; one input motion being from a feeder cycle triggering plunger, while the other is from a feed slide reversing trip bar. This relatively inexpensive mechanical linkage affords not only a simple direct arrangement for interfacing the feeder with the press but also provides a very fast valve control action.

The primary object of this invention is to provide an improved semi-automatic punch press feeder that is less expensive to make, is much easier to interface with the press, and is faster acting than prior pneumatic feeders.

Other objects will become apparent as the disclosure progresses.

BRIEF DESCRIPTION OF THE DRAWINGS

FIGS. 1 and 2 are diagrammatic views illustrating the nature of the operation of certain prior art punch press feeders.

FIGS. 3 and 4 are diagrammatic views illustrating the nature of the operation of the present feeder.

FIG. 5 is a plan view of the stock transport portion of the present feeder.

FIG. 6 is a front elevational view, in partial axial section, of the apparatus of FIG. 5.

DETAILED DESCRIPTION OF THE INVENTION

Figure 7:
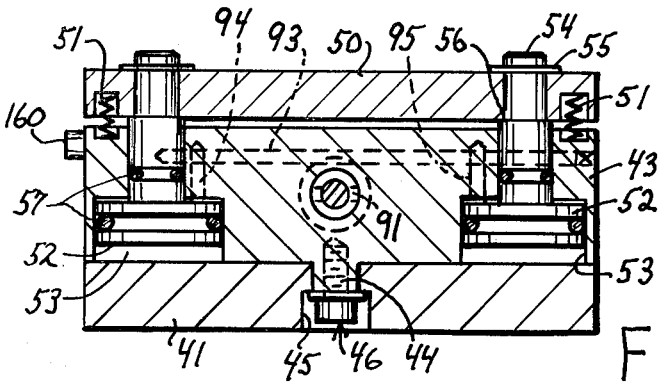
FIG. 7 is a sectional view of the feed slide taken along the transverse section line 7—7 of FIG. 6.

FIGS. 1 and 2 diagrammatically illustrate a conventional type of control for feeders which are adapted to be controlled by the operation of the punch press. In such conventional feeders a valve control plunger 20 is adapted to be vertically displaced by the press ram, and a stock advancing feed slide 22 is adapted to be reciprocated between two fixed stops 23 and 24. When the feeder valve control plunger 20 is moved downwardly as indicated by arrow 21 the feed slide 22 will be displaced through a non-feed stroke as illustrated by arrow 25 of FIG. 1. Thereafter during the following upward movement of the press ram the feeder valve control plunger moves upwardly as indicated by arrow 26 of FIG. 2 whereby the feed slide 22 will be displaced through a feed stroke as illustrated by arrow 27 of FIG. 2. In this type of control there is a feed slide movement in response to each downward movement of plunger 20 and in response to each upward movement of said plunger.

FIGS. 3 and 4 illustrate the control sequence for the present stock advancing feed slide means. Here when the press ram moves downwardly the control plunger 30 of the feeder will be thereby moved downwardly as indicated by arrow 31 of FIG. 3; however during this plunger movement the stock advancing slide 32 will remain in a normal rearward or indexed position as illustrated in FIG. 3. When the control plunger 30 is permitted to move upwardly, as indicated by arrow 33 of FIG. 4, in response to the upward movement of the press ram the feed slide 32 will be displaced first through a feed stroke and then automatically returned through a non-feed stroke to said normal indexed position, as indicated by arrow 34, and will remain there until the feeder is triggered again during the next upward stroke of the press ram. The FIGS. 3–4 type control thus provides for the semi-automatic sequencing of the feeder in response to each cycle of operation of the press ram.

Referring primarily to FIGS. 5, 6 and 7 the transport portion of the present improved semi-automatic feeder will be described first. The feeder frame may take any suitable form such as that shown in my U.S. Pat. No. 3,329,327 or may for example comprise a U-shaped frame member 38, FIG. 5, having a main body portion 40, an end block portion 41 and a plate like portion 42 interconnecting the lower regions of said main body and end block portions 40 and 41. Slidably mounted on the flat upper surfaces of said plate like portion 42 is a stock advancing feed slide 43 that is formed with a central depending key portion 44 that slidably engages a T-slot guideway 45 centrally formed in said plate like portion 42; the key portion 44 being vertically retained in said guideway by any suitable means such as a headed screw and washer arrangement 46 as is illustrated in FIGS. 6 and 7. A stock gripping means is carried by said feed slide 43 and comprises a grip bar 50 which is biased upwardly to a normal stock releasing position shown in FIG. 7 by suitable springs 51 and which is adapted to be moved downwardly by two similar single acting fluid motors that are carried by said feed slide. Each such fluid motor includes a piston 52 that is slidably disposed in a cylinder 53 formed in the feed slide and an integral piston rod 54 that extends upwardly through the top of the feed slide and through a suitable hole formed in said stock grip bar 50. A suitable ring fastener 55 secures the bar 50 against a shoulder 56 of each piston rod 54. Any suitable sliding O-rings seals 57 are provided where and as needed. As will be apparent when fluid pressure is admitted to the top portions of the two fluid cylinders 53 and the bar 50 will be moved downwardly against the action of springs 51 from its said stock release position to a stock gripping position.

The effective length of the feed stroke of feed slide 43 may be varied by means of a stroke adjusting screw 60 which threadedly extends through the said end block portion 41 and which may be secured in selected adjusted position by means of a lock nut 61 as is well understood in the art. The top of the end block 41 is formed with a transverse slot 62 in which a stock braking spring 63 is at least partially disposed, said spring having hooked ends that engage suitable holes such as 64, FIG. 6, formed in the two end faces of said end block portion 41. This spring-groove arrangement is adapted to laterally guide and apply a light braking force to the stock that is being fed through the feeder and between the spring 63 and the upper surface of said end block frame portion 41.

Figure 8:
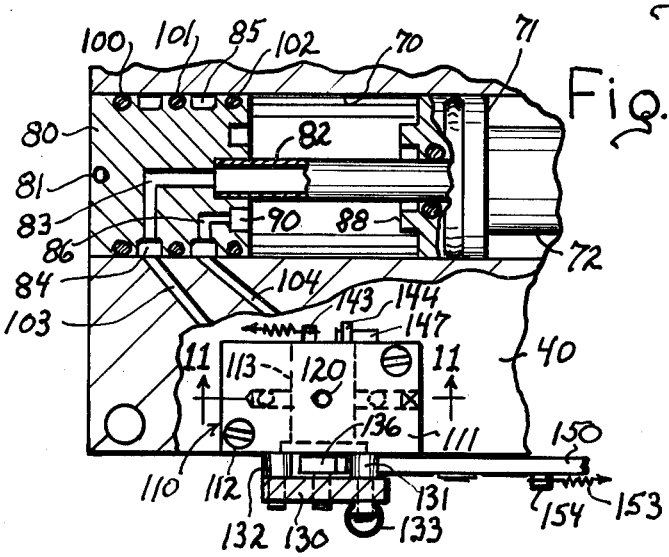
FIG. 8 is a plan view in partial section illustrating the feeder valve means and associated controls therefor and the construction and arrangement of the parts at the head end of the main cylinder of the feeder.

A fluid motor means is provided for reciprocating the feed slide 43; such means comprising a main cylinder 70 formed in the said main body portion 40 and a piston 71 slidably disposed therein. A tubular piston rod 72 integrally connected to said piston 71 extends axially through a collar 73 that is press fitted or otherwise secured in the end of cylinder 70. The shouldered outer end of the piston rod is received in a similarly shaped hole formed through the feed slide, as is best illustrated in FIG. 6, and a headed screw 74 which threadedly engages the outer end of the piston rod serves to secure said feed slide in fluid tight and fixed relation on and with respect to the said outer end of piston rod 72. The headed screw 74 and the outer end of the piston rod 72 are provided with suitable static fluid seals 75 as and where needed as illustrated in FIG. 6, while the piston 71 and collar 73 are provided with suitable sliding fluid seals 76 where and as needed as is also illustrated in FIG. 6. The opposite or forward end of the main cylinder 70 is closed by means of a plug 80, FIGS. 5 and 8, that is secured in the position shown by any suitable means such as a roll pin 81. As illustrated in FIG. 8 the plug 80 is formed with passages that deliver pressure fluid to and from the main cylinder and the grip cylinder, respectively and to this end a tube 82 is provided which is secured by any suitable means in a similarly shaped axially extending cylindrical recess formed in the inner end of plug 80 and which telescopically cooperates with the tubular piston rod 72. The plug is also formed with a first right angled fluid conducting passage 83 that communicates at one end thereof with the inside of tube 82 and at the other end thereof with a first annular groove 84 formed in the outer cylindrical surfaces of said plug. Plug 80 is formed with a second similar annular groove 85 and a second right angled passage 86 that provides communication between said annular groove 85 and an annular recess 90 formed in the inner face of said plug. An annular projection 88 formed on the inner face of piston 71 is adapted to cooperate with said recess 90 so as to thereby afford a buffer or cushioning effect for the terminal portion of each feed stroke of the instant feeder. As will be seen pressure fluid may flow to and from the head end of the main cylinder 70 through the annular groove 85, passage 86 and recess 90, and to and from the said grip fluid motors carried by the feed slide through said annular groove 84, passage 83, and tube 82. The fluid conducting line for the said gripper fluid motors is completed through the serially communicating passages defined by the tubular piston rod 72, FIG. 6, the radially extending holes 91, FIGS. 6 and 7, and an annular groove 92 formed in the outer cylindrical wall of the end of said piston rod 72, and passages 93, 94 and 95, FIGS. 5, 6 and 7 formed in the feed slide 43. Three suitable static seals 100, 101 and 102, FIG. 8, are provided on the plug 80 so as to insure the mutual isolation of the pressure fluid which flows through the annular grooves 85 and 84, respectively, and which actuates the main and gripper fluid motors respectively. The main body portion 40 of the feeder frame is formed with horizontally extending passages 103 and 104, FIG. 5, which respectively communicate with the said annular plug grooves 84 and 85 and with two vertical fluid conducting passages 105 and 106 respectively, FIGS. 5 and 6, that extend upwardly through the top surface of said main body portion 40. A third similar vertical passage 107 communicates with a lower horizontal passage 108 that in turn communicates with a fluid pressure supply line 109. The inner end of line 109 communicates with the rod end of the main cylinder 70 while the outer end thereof is enlarged and threaded as indicated at **109*a* of FIGS. 5 and 9**.

Figure 11:
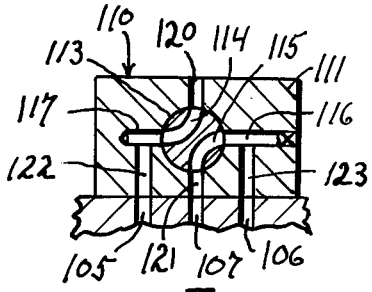
FIG. 11 is a sectional view of the control valve unit as taken along section line 11—11 of FIG. 8.

A mono-stable rotary four-way valve unit 110, FIGS. 8 and 11, is provided to control the flow of pressure fluid from supply lines 107–109 into and out of the said passages 105 and 106 so as to thereby properly sequence the operation of said main and gripper fluid motors. The valve 110 comprises a valve block 111 that is secured to the said main body portion 40 by any suitable fastening means such as screws 112. Rotatably mounted in valve block 111 is a rotary valve core 113 that is formed with two coplanar right angle passages 114, 115 as illustrated in FIG. 11. The four ends of passages 114, 115 are effectively spaced 90 degrees apart around the periphery of valve core 113. The valve block is drilled horizontally so as to form passages 116 and 117 having coextensive axes that are disposed diametrally with respect to the valve block aperture that receives said valve core 113; and is drilled vertically so as to form passages 120, 121 having vertical coextensive axes that are also disposed diametrally with respect to said valve block aperture. The inner ends of said passages 116, 117, 120 and 121 are effectively spaced 90 degrees apart. A vertical passage 122 formed in the valve block communicates with said passage 117, while a similar passage 123 communicates with said passage 116. As is shown in FIG. 11 when the valve block 110 is secured in place on the main body portion 40 the lower ends of passages 121, 122 and 123 will communicate with the upper ends of said passages 107, 105 and 106 respectively. The valve core 113 is adapted to be oscillated through 90 degrees between two predetermined positions. In the normal clockwise position illustrated in FIG. 11, pressure fluid will be supplied to and exhausted from the main fluid motor means and the gripper fluid motor means respectively, and the reverse is true when valve core 113 is turned counterclockwise 90 degrees. Any suitable restriction may be provided in one of the lines between the valve and the head end of the main cylinder so as to control the speed and timing of the actuation of the said fluid motor means as is well understood in the art. The fluid conductive lines 103, 104, 108, 93 and 116 are plugged at their respective outer ends so as to prevent leakage from the fluid circuit.

Figure 12:
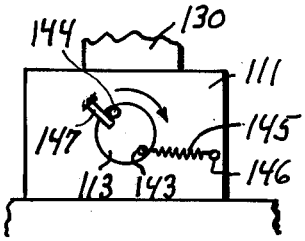
FIG. 12 is a rear elevation view of the valve unit taken in the opposite direction as that of FIG. 9.
Figure 9:
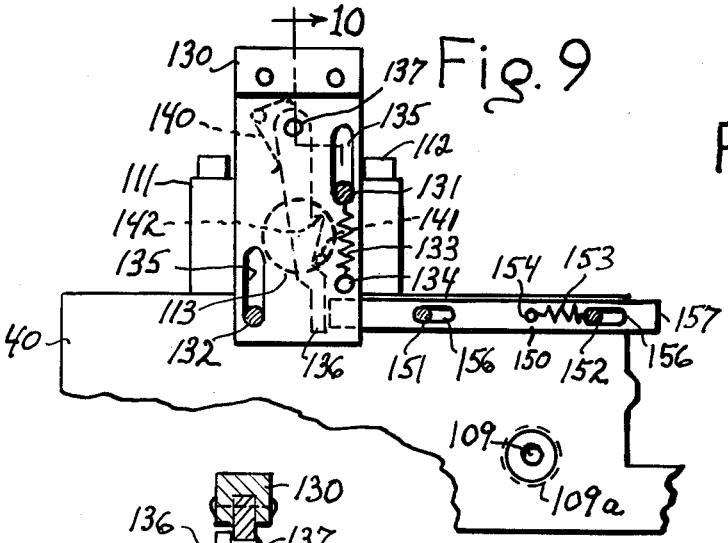
FIG. 9 is a front elevational view illustrating the valve control apparatus of FIG. 8.
Figure 10:
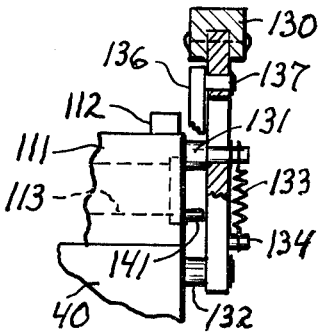
FIG. 10 is a left side elevational view (with certain parts broken away) of a portion of the apparatus shown in FIG. 9.

FIGS. 8–10 illustrate the mechanical means for oscillating or shifting the position of the valve core 113; which means includes a vertically reciprocable feeder cycle triggering plunger 130 that is slidably mounted on two spacer studs 131, 132 that are fixedly secured to the valve block 111 and frame body portion 40 respectively, the plunger being slidably retained on said studs by any suitable type fastener rings. A tension spring 133, FIGS. 9 and 10, secured between said stud 131 and a pin 134 carried by the plunger serves to bias plunger 130 to its normal upper position shown in FIGS. 9 and 10 as determined by engagement of said studs 131, 132 with the respective lower ends of the vertical slots 135 formed in said plunger 130. A latching means or driver pawl 136 is pivotally mounted on the inner side of plunger 130 by any suitable means such as a pin 137. A suitable torsion spring 140 serves to yieldably bias said pawl in a counter clockwise direction as seen in FIG. 9 so that the lower edge thereof is urged into engagement with a pin 141 extending out from the end of the valve core 113 as is best seen in FIGS. 9 and 10. The driver pawl or latching means 136 is formed with a shoulder 142, FIG. 9, that is adapted to cooperate with said valve core pin 141 during reciprocation of plunger 130. The inner end of the valve core 113 is provided with two diametrically opposed and inwardly extending pins 143 and 144. A tension spring 145, FIG. 12, is connected between said pin 143 and a pin 146 secured to the valve block 111 so as to normally rotatably bias said valve core in a counter clockwise direction as seen in FIG. 12 and in a clockwise direction as seen in FIG. 9 so that valve core 113 assumes the normal position shown in FIGS. 9, 11 and 12 as determined by engagement of the valve core pin 144, FIG. 12, with a suitable stop 147 that is secured by any suitable means to the valve block 111.

When the plunger 130 is in its normal upper position illustrated in FIG. 9 the lower end of the driver pawl or latch means 136 is disposed immediately in front of and substantially coplanar with respect to the adjacent end of a horizontal slide bar or trip reverse means 150 that is slidably carried on the side of the main body portion 40 by means of suitable pins 151 and 152 and associated fasteners rings on the latter. The slide bar is yieldably biased to a normal right hand position seen in FIG. 9 by means of a spring 153 that is secured between said pin 152 and a pin 154 fixed on said slide bar 150; this normal position being determined by the engagement of the said pins 151, 152 with the left ends of the respectively associated slots 156 formed in said slide bar 150. The outer or right end 157 of slide bar 150 as seen in FIG. 9 is adapted to be engaged and displaced to the left as seen in FIG. 9 by a pin 160, FIGS. 5 and 7, fixed to the side of feed slide 43 during the terminal portion of each feed stroke of the said feed slide 43; this leftward movement of the bar 150 serving to displace the said pawl 136 in a clockwise direction, as seen in FIG. 9, against the action of said spring 140. It will be noted that the time required for valve core 113, once released, to be spring returned to its feed normal position in FIG. 12, affords a short time delay which insures that a feed stroke is fully completed before a non-feed stroke commences.

Figure 13:
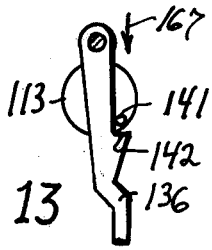
FIGS. 13, 14 and 15 are front elevational fragmentary views diagrammatically illustrating the sequence of operation of the feeder cycle triggering and reversing means that operatively shift the control valve during each cycle of operation of the present feeder.

The operation of the feeder will now be described. When pressure fluid is supplied to the said air line 109 the rod end of the main cylinder will be continuously biased by said pressure fluid and thus the feed slide 43 will be continuously urged in the feed direction as indicated by arrow 165 of FIG. 5. In the normal FIG. 11 position of the valve core 113 pressure fluid may flow from said supply line 109 through lines 108, 107, 121, 115, 116, 123, 106, 104, 85, 86 and 90 to the head end of the main cylinder whereby the feed slide will be displaced in a non-feed direction as indicated by arrow 166 of FIG. 5 to a normal indexed position determined by engagement of the slide 43 with the inner end of the stroke adjustment screws 60 as seen in FIG. 5. As will be apparent from FIG. 11 the valve core will simultaneously permit the exhaust of fluid pressure from the gripper motors on the feed slide 43 through lines 95, 94, 93, 92, 91, piston rod 72, tube 82 lines 83, 84, 103, 105, 122, 117, 114 and finally to the valve exhaust hole 120; thus the grip bar 50 will be moved by springs 51 to its upper or stock releasing position shown in FIG. 7. In this normal indexed position of the feed slide 43 the stock to be fed (generally indicated by arrow 5 of FIG. 6) is yieldably held stationary by the light frictional braking action of spring 63, FIGS. 5 and 6. The vertically reciprocable plunger 130 is adapted to be actuated by the vertical motion of the press ram whereby during the downward movement of said ram the plunger 130 will be displaced downwardly, against the action of spring 133, from its normal upper FIG. 9 position as indicated by arrow 167 of FIG. 13 until the pawl shoulder 142 swings underneath the valve core pin 141 as is diagrammatically illustrated in FIG. 13. During this downward movement of plunger 130 there is no resulting shift in the rotary position of valve core 113 and hence the feed slide 43 remains in its indexed position shown in FIG. 5.

Figure 14:
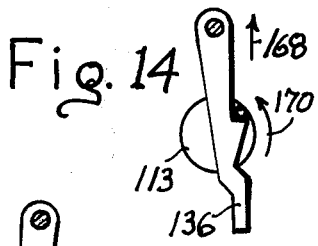

During the ensuing upward movement of the press ram plunger spring 133 will cause the plunger 130 to move upwardly, as indicated by arrow 168 of FIG. 14, to its said normal upper position thereby causing the pawl 136 to displace the valve core 113 in a counter clockwise direction through 90 degrees as indicated by arrow 170 of FIG. 14. The spring 133 is effectively stronger than spring 145, FIG. 12. The 90 degree shift of the valve core position from its normal FIG. 11 position will now cause pressure fluid to be supplied to the said stock gripper fluid motors carried by the feed slide and to be exhausted from the head end of the main cylinder 70 whereby the feed slide is displaced through a feed stroke in said feed direction 165 of FIG. 5. During the terminal portion of this feed stroke the feed slide pin 160 will engage and displace the trip slide bar 150 to the left as seen in FIG. 9 so that the slide bar displaces the driver pawl 136 in a clockwise direction as seen in FIG. 9. This displacement of pawl 136 will move the pawl shoulder 142 out from under the valve core pin 141, as is diagrammatically illustrated in FIG. 15, so that the spring 145, FIG. 12, is now free to return the now released valve core 113 through 90 degrees to its said normal position as indicating by arrow 175 of FIG. 15. When the valve core thus snaps back to its said normal FIG. 11 position the feed slide will again partake of a non-feed stroke and return to its said normal FIG. 5 position, and the trip slide bar 150 and pawl 136 will also return to their respective normal FIG. 9 positions under the action of springs 153 and 140 respectively. The feed slide 43 will remain in said normal indexed or FIG. 5 position until the next operative cycle of the press produces the next semi-automatic cycling of the instant feeder in a manner similar to that just described.

Figure 15:
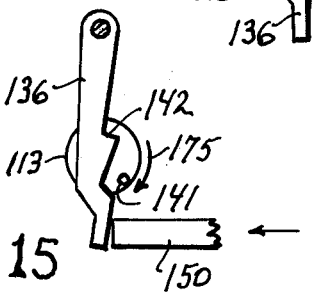

The principal advantages of the present construction and arrangement are, first no complex interfacing is required between the present semi-automatic feeder and the press; the only requirement here being that the press ram simply operate the plunger 130. Secondly the relatively simple feeder cycle triggering action of the upward motion of driver pawl 136, as illustrated in FIG. 14, and the equally simple and direct reversing or valve tripping action afforded by the leftward motion of the trip slide bar 150, as illustrated in FIG. 15, permits a reliable fast acting control for oscillating the valve means so as to produce a more efficient semi-automatic control means for the feed slide movement as described in connection with FIGS. 3 and 4. Thirdly the construction and operation of the present valve and valve control linkage is such as to afford a semi-automatic action for the feeder at only a minor increase in cost over that for a feeder that operates in the conventional manner described in connection with FIGS. 1 and 2.

I claim:

1. A semi-automatic feeder for intermittently advancing stock into the work station of a punch press, the latter having a reciprocating ram: said feeder comprising a frame;

stock advancing means mounted on said frame and adapted to grip said stock and move through a feed stroke, and to release said stock and move through a non-feed stroke;

fluid motor means adapted to actuate said stock advancing means through said feed and non-feed strokes;

valve means for said fluid motor means and having first and second operative conditions, said valve means being normally disposed in said first operative condition so as to be thereby adapted to cause said fluid motor means to displace said stock advancing means through a non-feed stroke to a normal indexed position, said valve means when shifted to its said second operative condition being adapted to cause said fluid motor means to displace said stock advancing means through a feed stroke; and a semi-automatic mechanical control means for controlling the operative shifting of said valve means between its said first and second operative conditions in response to the reciprocation of said ram:

said mechanical control means including a feeder cycle triggering plunger means adapted to be reciprocally moved away from and towards a normal position in response to the downward and upward movement respectively of the ram of said punch press;

driver means carried by said plunger means and adapted to displace said valve means from its said first condition to its said second condition in response to said movement of said plunger means toward its said normal position so as to cause said stock advancing means to partake of a feed stroke; and slide bar means adapted to be displaced in response to the terminal portion of said feed stroke of said stock advancing means for causing said valve means to be shifted back to said first condition so that said stock advancing means will immediately partake of a non-feed stroke and return to its said normal indexed position and remain there until the next cycle of operation of said press.

2. Apparatus as defined by claim 1 wherein said plunger means is yieldably biased to its said normal position.

3. Apparatus as defined by claim 1 wherein said driver means includes a latching pawl that is mounted on said plunger means.

4. Apparatus as defined by claim 1 wherein said valve means includes a valve member that is adapted to be rotatably oscillated in alternate clockwise and counter clockwise directions between two predetermined rotary positions.

5. Apparatus as defined by claim 1 wherein said valve means is yieldably biased to said first condition, wherein said driver mans includes a latching member, and wherein said slide bar means when displaced by said stock advancing means is adapted to displace said latching member thereby permitting said biased valve means to return to its said first operative condition.

6. Apparatus as defined by claim 5 wherein said latching member comprises a pawl, wherein said plunger means is yieldably biased to its said normal position and is adapted in being so yieldably moved to its normal position to cause said latching pawl to displace said valve means to its said second operative condition, and wherein said slide bar means when displaced is adapted to effectively disable said latching pawl so as to permit said biased valve means to return to its said first operative condition.

7. Apparatus as defined by claim 6 wherein said stock advancing means includes a reciprocating feed slide that is adapted to be continuously in a stock feed direction.

8. A pneumatically operated feeder for intermittently advancing strip stock into the work station of a punch press having a reciprocating working ram: comprising a frame;

a feed slide carried by said frame for reciprocation in feed and index directions;

stock gripping means carried by said feed slide;

a first fluid motor means for actuating said feed slide;

a second fluid motor means for actuating said stock gripping means;

control means for controlling the operation of said first and second fluid motor means, said control means comprising a feed index cycle triggering plunger means carried by said frame and being movable between a first position and a depressed position in response to the movement of the ram of said press, said plunger means when in its first position being adapted to be displaced to its depressed position in response to the downward movement of said press ram, and to be moved back to its said first position in response to the upward movement of said press ram;

valving means having first and second operative conditions;

means responsive to the movement of said cycle triggering plunger means from its said depressed position back to said first position for placing said valving means in its said second operative condition and causing said first and second fluid motor means to produce a feed stroke of said feed slide; and reverse means operable in response to the terminal portion of said feed stroke for causing said valving means to be restored to its said first operative condition and causing said first and second fluid motor means to return said feed slide to an indexed position where it will remain until said plunger means is again moved from its said first position to a depressed position in response to the downward movement of said ram and thereafter moved back towards its said first position in response to the upward movement of said ram whereby said valving means is again moved to its said second condition so as to thereby initiate the next feed index cycle of said feeder in response to the return movement of said plunger means back to its said first position.

9. A semi-automatic feeder for intermittently advancing strip stock into the workk station of a punch press that has a reciprocating working ram: comprising a frame;

a feed slide carried by said frame for reciprocating movement in feed and index directions;

stock gripping means carried by said feed slide;

a first main double acting fluid motor means for actuating said feed slide, said first fluid motor means having a head end and a rod end;

a second fluid motor means carried by said feed slide for actuating said stock gripping means;

means adapted to continuously supply pressure fluid to said rod end of said first double acting fluid motor means so as to continuously bias said feed slide in said feed direction;

valve means having first and second operative conditions;

valve shifting means adapted to move said valve means to its said first operative condition so that said feed slide is moved to and remains in an indexed position;

a feed index cycle triggering plunger means carried by said feeder frame and being movable between a first position and a depressed position in response to the movement of said press ram, said plunger means when in its said first position being adapted to be displaced to its said depressed position in response to the downward movement of the said press ram;

means adapted to move said plunger towards said first position so that said plunger means may follow the upward movement of said ram and thus be restored to its said first position;

means responsive to the said upward movement of said cycle triggering plunger means towards its said first position when following the upward movement of said press ram for shifting said valve means to and holding the latter in said second operative condition thereof so as to exhaust pressure fluid from said head end of said first fluid motor means and to supply pressure fluid to said second fluid motor means thereby initiating a feed stroke of said feed slide; and valve release means adapted to be operated in response to a terminal portion of the feed motion of said feed slide for causing said valve shifting means to restore said valve means to its said first operative condition so as to thereby supply pressure fluid to said head end of said first fluid motor means and to exhaust pressure fluid from said second fluid motor means whereby said feed slide moves to its said normal indexed position where it will remain until the next feed index cycle of said feed slide is initiated in response to the next movement of said plunger means back to its said first position.

10. Apparatus as defined by claim 9 wherein said valve shifting means comprises a valve biasing means that is adapted to continuously yieldably urge said valve means to its said first operative condition, and wherein biasing means is provided to yieldably bias said plunger means to its said first position where it normally remains.

11. Apparatus as defined by claim 9 wherein said valve means has two operative output lines, said valve means when in its said first operative condition being adapted to supply pressure fluid through one of said output lines to the head end of said first fluid motor means while pressure fluid is simultaneously exhausted through the other of said output lines from said second fluid motor means whereby said feed slide partakes of an index stroke, said valve means when in its said second operative condition being adapted to exhaust fluid through said one valve output line from the head end of said first fluid motor means while pressure fluid is simultaneously supplied through said other valve output line to said second fluid motor means whereby said feed slide partakes of a feed stroke.

12. Apparatus as defined by claim 8 wherein said valving means includes a valve member that is adapted to be rotatably oscillated in alternate clockwise and counter clockwise directions between two predetermined rotary positions.

13. Apparatus as defined by claim 8 wherein said control means includes a biasing means that is adapted to yieldably bias said valving means to its said first operative condition, and wherein said valving means when in its said second operative condition being adapted to be released by operation of said reverse means for movement back to its said first operative condition under the action of said biasing means.

14. Apparatus as defined by claim 8 wherein said frame is substantially U-shaped and comprises a main body portion, an end block, and an intermediate plate like portion on which said feed slide reciprocates, said plate like portion being integrally formed with said main block portion.

15. Apparatus as defined by claim 8 wherein one and only one feed stroke is executed by said feed slide in response to each actuation of said plunger means, and wherein each feed stroke of said feed slide is initiated only in response to the operation of said plunger means.

16. In a pneumatic stock feeder that is adapted to intermittently advance stock into the work station of a punch press that has a reciprocating working ram; said feeder including a frame;

a feed slide carried by said frame and mounted for reciprocation in feed and index directions;

stock gripping means carried by said feed slide;

a first fluid motor means for actuating said feed slide;

a second fluid motor means for actuating said stock gripping means; and valve means having first and second operative conditions, said valve means when in its said first operative condition causing said feed slide to move through an index stroke to a normal indexed position; the improvement comprising a semi-automatic control means for said first and second fluid motor means operative in response to the cyclic reciprocating movement of the ram of said punch press and adapted to initiate a feed index cycle of movement of said feed slide in response to the retractive upward movement of said ram, said semi-automatic control means including trigger means adapted to be operated in response to the said retractive upward movement of said ram for placing said valve means in its said second operative condition and causing said first and second fluid motor means to move said feed slide through a feed stroke, each feed stroke of said feed slide being initiated only in response to operation of said trigger means; and reversing means operable in response to the terminal portion of said feed stroke for causing said valve means to be restored to its said first operative condition and causing said first and second fluid motor means to move said feed slide through an index stroke and back to said indexed position where it will remain until said trigger means is again operated in response to the next upward movement of said press ram whereby said valve means is again moved to its said second condition so as to thereby initiate the next feed index cycle of said feeder.

17. Apparatus as defined by claim 16 wherein one and only one feed stroke is executed by said feed slide in response to each actuation of said trigger means, and wherein said feeder control means includes no output means for controlling said press.

18. Apparatus as defined by claim 9 wherein one and only one feed stroke is executed by said feed slide in response to each actuation of said plunger means, and wherein each feed stroke of said feed slide is initiated only in response to the operation of said plunger means.

* * * * *